US005249512A

United States Patent [19]

Christenson

[11] Patent Number: 5,249,512

[45] Date of Patent: Oct. 5, 1993

[54] HYDROSTATIC PUMP AND MOTOR

[76] Inventor: Howard W. Christenson, 128 West 73rd St., Indianapolis, Ind. 46260

[21] Appl. No.: 885,722

[22] Filed: Mar. 20, 1992

[51] Int. Cl.[5] ..... F01B 13/06; F04B 1/06; F04B 1/04

[52] U.S. Cl. ..... 91/491; 91/497; 417/219; 417/273

[58] Field of Search ..... 417/219; 91/497, 498, 91/491; 92/12.1, 72

[56] References Cited

U.S. PATENT DOCUMENTS

| | | | |
|---|---|---|---|
| 2,501,165 | 3/1950 | Ferris | 91/497 |
| 2,823,619 | 2/1958 | May | 91/498 |
| 2,838,003 | 6/1958 | Joy | 91/498 |
| 3,101,078 | 8/1963 | Evans | 417/462 |
| 3,274,946 | 9/1966 | Simmons . | |
| 3,747,477 | 7/1973 | Aldinger | 91/497 |
| 3,791,703 | 2/1974 | Ifield . | |
| 4,128,048 | 12/1978 | Nishiba | 91/491 |

FOREIGN PATENT DOCUMENTS

| | | | |
|---|---|---|---|
| 1453686 | 2/1969 | Fed. Rep. of Germany | 91/497 |
| 149819 | 7/1981 | Fed. Rep. of Germany | 91/497 |

OTHER PUBLICATIONS

Product Brochure of Voith Transmissions, Inc., Voith Radial Piston Pumps.

*Design and Application of 40° Hydraulic Motors*, Leif Andersin and Craig Klocke, SAE Technical Paper Series, 1985 International Off-Highway & Powerplant Congress & Exposition, Mecca, Milwaukee, Wisc., Sep. 9-12 1985.

General Electric and the U.S. Army's Tank-Automotive Command (TACOM) article.

*Broader Horizons With High Efficiency Pumps and Motors*, Hugh I. Frazer, Ifield Engineering, Australia.

*Primary Examiner*—Richard A. Bertsch
*Assistant Examiner*—Roland McAndrews

[57] ABSTRACT

A hydrostatic pump and motor combination is disclosed including a rotor having radially disposed cylinders containing reciprocatably disposed spherical balls therein. A free outer race is eccentrically disposed about the rotor to define either a pump or motor. The cylinders are tilted relative to the center of the rotor to reduce side torque thrust loads on the cylinders. Also disclosed are a hydrostatic pump and motor including matching spherical slipper shoes and spherical free outer race. Hydrostatic thrust cups are disposed within the cylinders to reduce frictional losses, wear, and leakage. The thrust cups include hydrostatic means for supporting the balls in the cylinders, thereby self adjusting in response to fluid pressure and centrifugal loads.

14 Claims, 5 Drawing Sheets

HYDROSTATIC PUMP AND MOTOR

BACKGROUND OF THE INVENTION

The present invention relates generally to hydrostatic pumps and motors and, more specifically, to ball and piston hydrostatic pumps and motors.

Hydrostatic pumps and motors are increasingly being used in the transfer of power due to their input/output flexibility, infinitely variable control and inherent overload protection. One such power transmission device is the bent-axis piston pump or motor, wherein the motor or pump includes parallel axis cylinders having pistons reciprocating therein.

Another power transmission device is the radial pump or motor. One example of a radial pump or motor is the hydrostatic transmission disclosed by Simmons, U.S. Pat. No. 3,274,946. Because of the inherent high fluid pressures generated by hydrostatic pumps or motors, improvements thereto have generally focused on hydrostatically balancing resultant reaction loads so as to minimize size and complexity of the motor, while still providing maximum torque transmission.

For example, Ifield, U.S. Pat. No. 3,791,703, discloses a journal support bearing for rotating shafts, in which the journal support bearing includes a hydrostatically balanced slipper positioned within a stationary housing.

Most axial piston motors develop torque via side thrust loads transmitted across a ball joint at the the end of the pistons, wherein the side thrust loads are converted to torque by a disk articulatably rotating about its central axis. The long piston seals common to axial piston motors tend to limit leakage thereacross; however, at high loads and speeds the pistons in larger size motors can become sufficiently hot so as to seize within the cylinders. Also, at high rotating speeds sudden changes in loading can lift the rotor off the valve seat due to the high centrifugal loads, resulting in loss of drive.

Bent axis designs tend to reduce the piston side torque loads. However, double end ball push rods and large capacity thrust bearings and support structure are required for the variable reversible type motors. Furthermore, unbalanced high working fluid pressures can distort the cylinder housing and increase friction and heat build-up in the pistons.

Radial type pumps and motors include rotors which cannot lift off the pintle valve seat. Rather than having long stroke cylinders and pistons which substantially increase frictional losses with speed, the ball piston pump is a compact, high strength design employing large diameter cylinders with ball pistons having short strokes to increase capacity. For example, the stroke of the ball piston must be less than the ball radius. Also, the diametral clearance between the ball and cylinder is minimized to limit leakage. Still, CARBOLOY® cylinder liners, or other heat resistant liners, have been required to withstand the high temperatures caused by high torque loads occurring at high speeds. As a result, commercial radial units have fallen out of favor due to their cost and weight.

Therefore, there is a need for further improvements which reduce misalignment, leakage, cost and undesirable side torque loads and their associated frictional losses in a hydrostatic pump or motor. An improved hydrostatic pump/motor is desired which further balances fluid pressure loads therein. Such a fluid transmission device would be a radial hydrostatic pump/motor, in which loads are better distributed to reduce point contact loading and its resulting wear. Such a pump/motor would also include improved mechanical interfaces, wherein wear and slippage are further reduced. Such a pump/motor would be suitable for high speed motor vehicle propulsion and might find application in the bell housing of a Hydrocycle engine.

SUMMARY OF THE INVENTION

A hydraulic pump/motor is disclosed including a housing and a pintle mounted within the housing. The pintle includes a plurality of inlet fluid passageways and a plurality of exit fluid passageways. The plurality of inlet fluid passageways receive working fluid supplied to the pump/motor and the plurality of exit fluid passageways exhaust working fluid from the pump/motor. A rotor is rotatably received on the pintle. The rotor includes a plurality of radially disposed cylinders therein and fluidly coupled to the pintle. A plurality of spherical balls are included corresponding to the plurality of cylinders in the rotor. Each of the plurality of spherical balls is reciprocatably disposed within a corresponding one of the plurality of cylinders. A bearing race is rotatably disposed about the rotor and pintle. The bearing race contains the spherical balls within the cylinders. A thrust pad rotatably supports the bearing race. Means for translating the thrust pad and bearing race relative to the pintle and rotor are included so as to dispose the bearing race eccentric to the pintle and rotor.

One object of the present invention is to provide an improved hydrostatic pump/motor.

Another object of the present invention is to provide a radial hydrostatic pump/motor incorporating an improved slipper shoe.

Another object of the present invention is to provide a hydrostatic pump/motor having a stator race free to rotate with the rotor at a near synchronous carrying velocity to reduce rolling or sliding contact with the radial pistons.

Another object of the present invention is to provide a hydrostatic pump/motor in which the rotor pistons locate the free body stator race in alignment with the rotor, wherein resultant race loads are hydrostatically supported.

Another object of the present invention is to provide a hydrostatic pump/motor having reinforced TEFLON® cups to seal, center, and hydrostatically support the ball pistons.

Another object of the present invention is to provide a hydrostatic pump/motor in which the radial cylinders are tilted to reduce torque vector side loads.

Another object of the present invention is to provide a hydrostatic pump/motor having matching spherical race and slipper shoes to improve alignment and wear characteristics.

Another object of the present invention is to provide a floating stator race which carries the radial piston reaction loads at near synchronous velocity with improved alignment, thereby reducing bearing friction and churning losses.

Another object of the present invention is to provide a floating stator race with a spherical inner race surface and matching spherical radial pistons hydrostatically supported thereon, thereby improving alignment and reducing wear.

Another object of the present invention is to provide a radial hydrostatic pump/motor having hydrostatic pintle loads equal to hydrostatic stator reaction loads to provide a true balanced hydrostatic torque couple, wherein the eccentricity distance between the rotor center and the stator center develops torque therewith while minimizing bearing loads.

Another object of the present invention is to provide a hydrostatic pump/motor having low-friction bearing and seal components to reduce friction and leakage.

Another object of the present invention is to provide a hydrostatic pump/motor which can rotate at high speeds with nominal friction and minimal eccentricity to accommodate sudden changes in power.

Another object of the present invention is to provide an improved ball type radial motor including an improved mounting of the bearing race.

Related objects and advantages of the present invention will be apparent from the following description.

FIG. *7a* is a side cross-sectional view of a bushing cup in its free state.

FIG. *7b* is a side cross-sectional view of the bushing cup of FIG. *7a* assembled about a ball piston and within a bushing housing.

Figure 6:
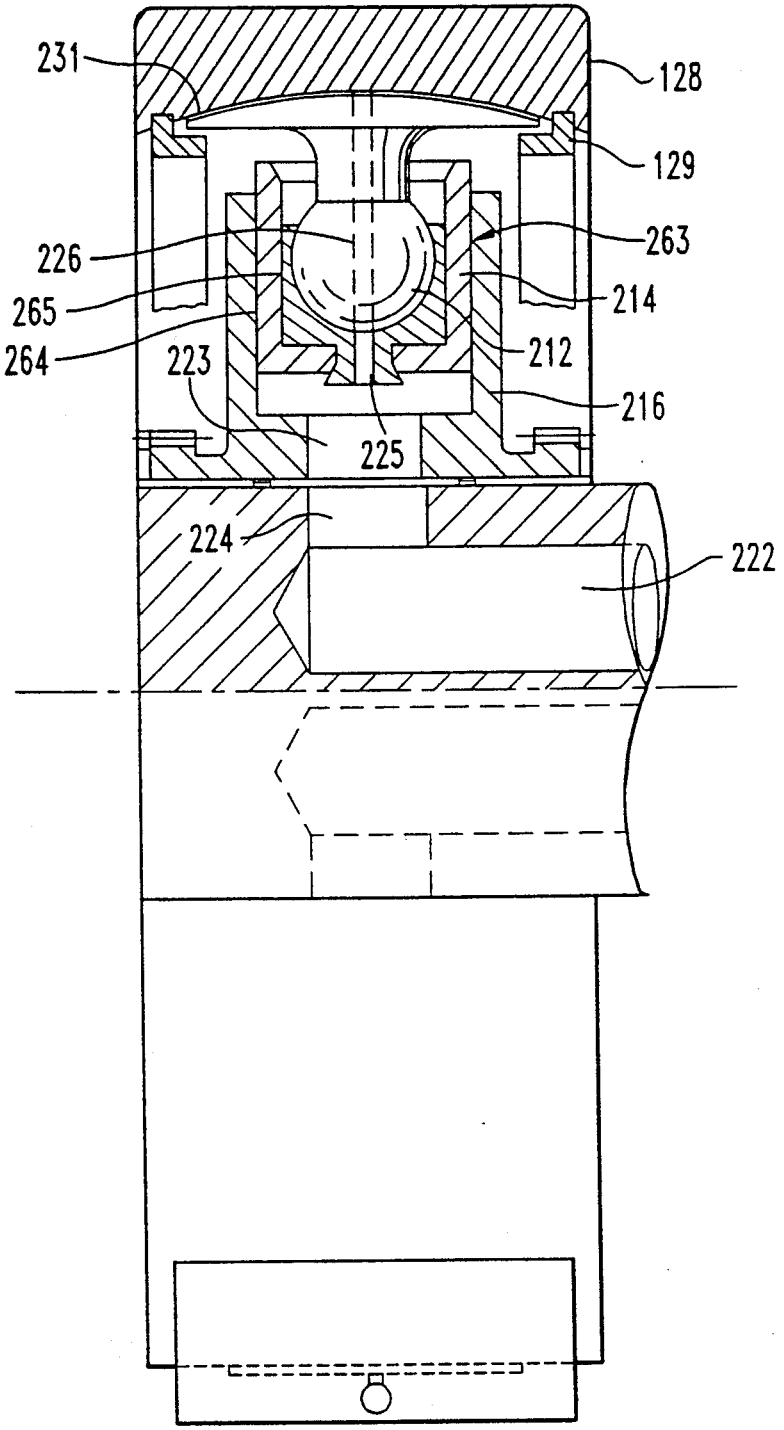
FIG. 6 is a partial side cross-sectional view of a ball piston-type radial hydrostatic pump/motor according to yet another embodiment of the present invention.

FIG. *7c* is a rear elevational view of a ball piston of the ball piston-type radial hydrostatic pump/motor of FIG. 6, including a hydrostatic recess which supports the ball piston on a bearing race.

DESCRIPTION OF THE PREFERRED EMBODIMENT

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
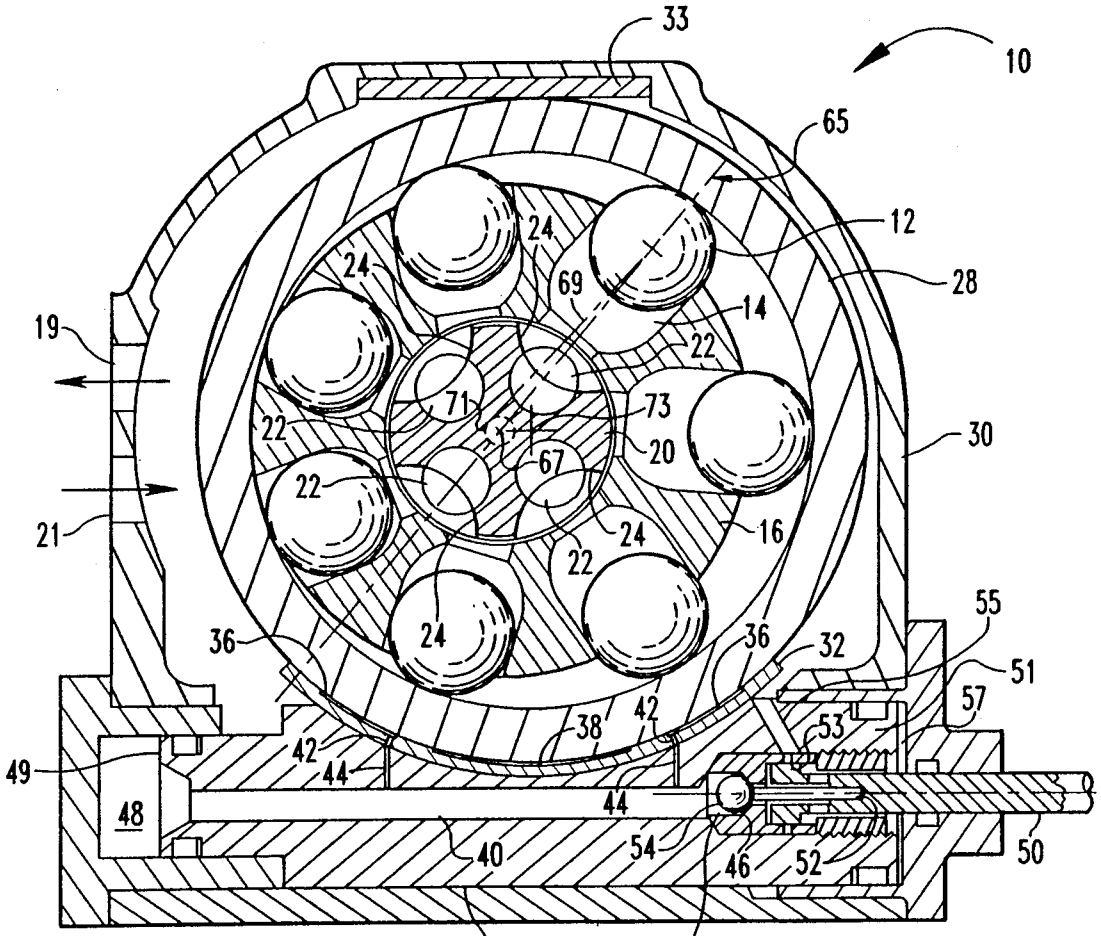
FIG. 1 is a front cross-sectional view of a ball-type radial hydrostatic pump/motor according to one embodiment of the present invention.

Referring now to FIG. 1, a hydrostatic pump/motor 10 is shown in a forward or pumping position. Pump/motor 10 is essentially a ball/piston radial motor including a plurality of spherical balls 12 operating as pistons within a corresponding plurality of cylinders 14 in rotor 16. A bearing outer race 28 is disposed about the balls and rotor to define a limit to the travel of the balls within the cylinders. In both the pump and motor modes, the outer race is located eccentric with respect to the centerline 67 of the rotor. As such, rotation of the rotor within the outer race results in the balls reciprocating within the cylinders.

In the pump mode, mechanical power is provided to the rotor via mechanical rotation of the rotor. The mechanical power is converted to fluid power by the balls reciprocating within the cylinders to displace the working fluid therefrom. Conversely, in the motor mode, fluid power is provided to the rotor via the pressurized working fluid acting on the rotor. The fluid power is converted to mechanical power by the fluid pressure in each cylinder creating a net torque on the rotor. By translating the outer race relative to the rotor and changing the eccentricity, the pump/motor 10 can be made to operate in either the pump or motor mode.

Working fluid is communicated with the rotor via a pintle 20. Similar to a journal bearing, lubrication is provided to the reduced clearance between the rotor and pintle so that the rotor 16 rotate freely about pintle 20 with minimal frictional losses. The pintle includes longitudinal passageways 22 and radial passageways 24 to communicate working fluid with passageways 23 of the rotor. In one embodiment, four longitudinal passageways 22 and corresponding radial passageways 24 are provided in the pintle and which communicate working fluid with seven cylinders 14 via a corresponding number of radial passageways 23 in the rotor. Ports 19 and 21 communicate working fluid with the associated fluid passageways 22 and 23 and operate as both inlet and outlet ports to the pump/motor depending on the mode in which the pump/motor operates.

An odd number of cylinders 14 is preferred in rotor 16 so that as the rotor rotates about the pintle, one piston/cylinder combination is in transition between receiving and exhausting working fluid with the pintle. As such, working fluid output pressure pulses are reduced to provide a smoother torque output. Mechanical power is transferred externally of the pump/motor via splines 18 (see FIG. 2). These splines mesh with mating splines on related power shafting to efficiently communicate power.

Pump/motor 10 contains the various pumping elements within a housing 30. The housing is sized to permit translation of the outer race relative to the rotor and pintle and allow variable eccentricity and reverse flow between the outer race and the pintle. Unlike conventional hydrostatic pumps or motors which fix the outer race against rotation within the housing, pump/motor 10 incorporates a free floating outer race capable of rotation relative to the housing. A partially cylindrical thrust pad 32 supports the outer race 28 and resultant torque vector loads against a stationary thrust pad 33 within the housing. As a result, balls 12 oscillate more than roll against the outer race. Outer race 28 is free to rotate on thrust pad 32 at near synchronous speeds with the rotor as the balls 12 orbit in the rotor.

Thrust pad 32 is mounted on a piston or servo member 34. Servo member 34 is rotatable within the housing to be self-aligning with the bearing race. Servo member 34 also translates the outer race within the housing to vary the eccentricity of the outer race relative to the rotor.

To reduce friction resulting from slippage of the outer race on the thrust pad and to distribute loads transferred from the outer race, thrust pad 32 includes fluid-filled recesses 36 and 38 which hydrostatically support the outer race on the thrust pad. Recesses 36 receive working fluid from piston member passageway 40 via passageways 42 and 44. A ball 54 seats against a seat 46 to seal working fluid within the passageways and the recesses to maintain fluid pressure therein. Recess 38 is located between recesses 36 and, therefore, defines a sealed hydrostatic fluid recess therebetween. The number of hydrostatic recesses can vary in size and number depending on the application and loads resulting therefrom. For example, smaller radial pump/motors may require only a single hydrostatic recess.

In addition to providing hydrostatic support of the outer race, pressurized fluid is also employed to translate piston member 34 within the housing. Pressurized fluid is supplied to fluid chamber 48 to provide the necessary working pressure for biasing the piston member in the housing and defining either the motor or pumping mode of pump/motor 10.

To control the operation of the piston member, an actuating rod 50 is employed. Actuating rod 50 is a push/pull rod which incorporates a pin 52 and sealing member 53 at its pump/motor end. In one embodiment, end 51 of the servo piston 34 has twice the cross-sectional area of end 49 to create a net thrust which biases the piston member eccentrically towards the pumping mode when chambers 48 and 57 are equally pressurized. As such, the piston member operates similarly to power steering units in that chamber 48 is maintained pressurized by high pressure input oil, wherein the pressurized working fluid both controls the amount of eccentricity and maintains the hydrostatic bearing support.

Pressurized working fluid in chamber 48 provides a constant thrust force on servo piston 34 and ball 54. In operation, when actuating rod 50 is advanced within the housing of the pump/motor, pin 52 physically unseats ball 54 from seat 46. Concurrently, sealing member 53 blocks vent passageway 55 to prevent venting of pressurized fluid therefrom and route pressurized fluid from chamber 48 to chamber 57. Because of the difference in cross-sectional areas of ends 49 and 51, piston member 34 is biased in the housing until ball 54 is seated so as to define the motor mode of pump/motor 10. As such the degree of eccentricity is determined by the position of the actuating rod relative to the housing.

Conversely, when rod 50 is retracted from the pump/motor, ball 54 seats to seal oil within chambers 40 and 48. Concurrently, sealing member 53 unblocks vent passageway 55 to vent pressurized working fluid therethrough. Because of the fluid pressure differential in the chambers, piston member 34 is oppositely biased to define the pump mode of pump/motor 10.

Figure 2:
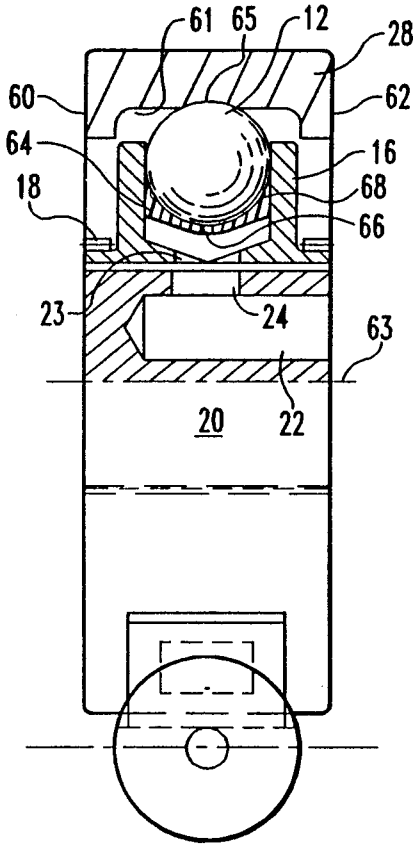
FIG. 2 is a partial side cross-sectional view of the ball-type radial hydrostatic pump/motor of FIG. 1.

Referring now to FIG. 2, the balls 12 of the hydrostatic pump/motor 10 are shown restrained within rotor 16 and against outer race 28. Outer race 28 includes side rails 60 and 62 defining a recess 61 therebetween to improve stiffness of the bearing race and provide clearance for the rotor as it translates between the pump and motor modes. A conventional ball race 65 is ground in the center of recess 61 to positively locate the bearing race as it orbits in the plane of the rotor and balls. Because the outer race 28 is free to rotate, centrifugal forces cause some fluid to accumulate in recess 61, thereby enhancing lubrication between the balls 12 and outer race 28.

Contained within each of the cylinders 14 is a thrust cup 64. Thrust cup 64 is constructed from fiber reinforced TEFLON® for providing low-friction load transfer between each of the balls and corresponding cylinders. Each of the thrust cups is fitted within cylinder 14 and includes a semi-spherical surface for conforming to spherical ball 12. Centrifugal forces and fluid pressure within the cylinder act on the thrust cup to seat the thrust cup against the ball. An orifice 66 communicates fluid to a peripheral groove 68 to hydrostatically balance thrust, seal, support, and center the ball 12 within the cylinder 14. As such, the thrust cup seals 64 are self-aligning within the cylinders so that ball 12 operates primarily against the thrust cup rather than the cylinder to reduce wear.

Referring back to FIG. 1, each of the cylinders 14 are tilted with respect to a radial line 65 passing through the center 67 of the rotor 16 and pintle 20. As such, the cylinders define a plurality of tilted cylinder axis 69. The cylinder axes define a plane of rotor 16 in which radial thrust loads locate bearing race 28. Any misalignment of the rotor and bearing race is accommodated by the servo piston, wherein piston member 34 rotates within the housing about its longitudinal axis to align the bearing race 28 with the plane of the rotor through which the radial thrust loads are transferred. Each of the tilted cylinder axes when extended pass adjacent to center 67 and tangent to an imaginary circle 71 centered about center 67. In one embodiment, imaginary circle 71 has a radius one-half of the eccentricity between center 67 of the pintle and rotor and center 73 of the outer race. By tilting the cylinders, the magnitude of the forces transferred between the ball and cylinder are reduced. As a result, frictional losses and wear are further reduced.

Figure 3:
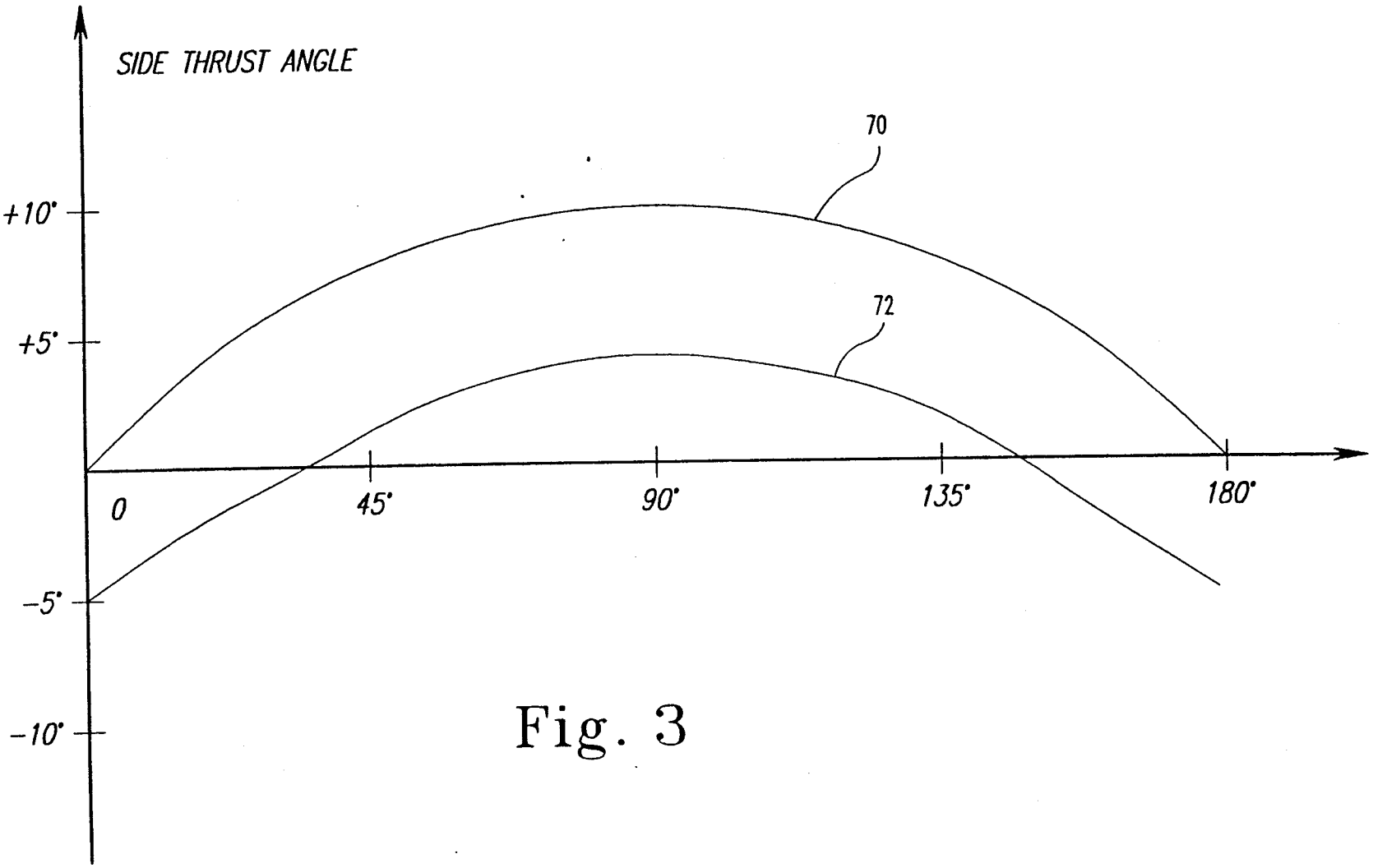
FIG. 3 is a graph comparing thrust angles and associated side loads of a ball-type hydrostatic pump/motor having radial cylinders with a ball-type hydrostatic pump/motor having tilted cylinders.

Referring now to FIG. 3, the thrust angle of the ball relative to the cylinder is shown plotted against the cylinder rotation as the rotor rotates the cylinder through 180 degrees. Because thrust angle is indicative of loads transferred between the ball and cylinder, side loads resulting in friction and wear are represented as well by FIG. 3. Curve 70 represents the side thrust angle and load associated with a ball reciprocating within a radial cylinder, while curve 72 represents the side thrust angle and load associated with a ball reciprocating within a tilted cylinder. As indicated by curve 70, a radial cylinder results in the side load being transferred between the ball and a side of the cylinder and varying between zero and maximum as the rotor rotates the ball and cylinder through 180 degrees. For a tilted cylinder, loads are transferred across either side of the cylinder, causing the side load to be varied in direction as well as magnitude. The piston sliding velocity starts at zero at the side and is maximum at the center. As shown by curve 72, the maximum load is halved and distributed across both sides of the cylinder, thereby improving lubrication.

Figure 4:
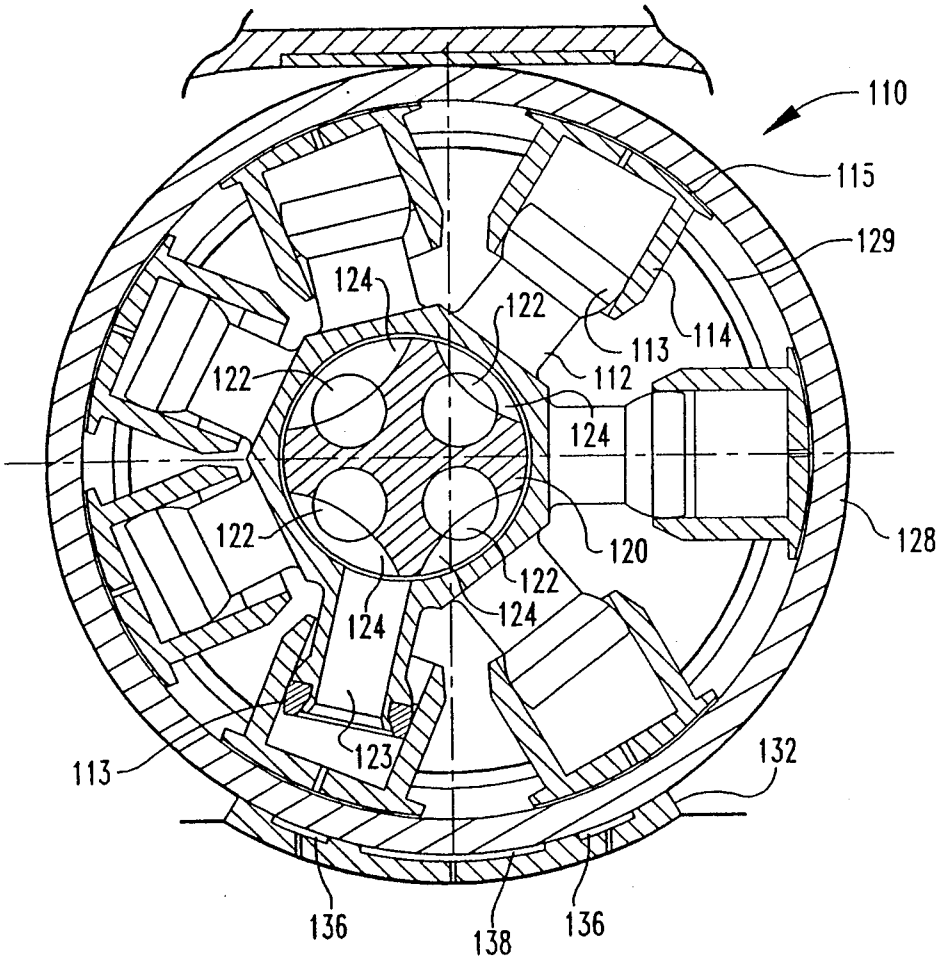
FIG. 4 is a partial front cross-sectional view of a slipper shoe-type radial hydrostatic pump/motor according to another embodiment of the present invention.

Other hydrostatic pumps and motors incorporating improvements in efficiency and reduced wear are also contemplated. Referring now to FIG. 4, a hydrostatic pump/motor 110 is shown with spokes 112 reciprocating within orbiting pump cylinders 114. Each spoke includes a spherically crowned bearing portion 113 for sealing the cylinder while reducing friction and minimizing wear. Similar to pump/motor 10, a rotor 116 is eccentric with an outer race 128. Rotor 116 rotates about pintle 120 to reciprocate the spokes within the cylinders due to the eccentricity therebetween. Working fluid communicates between the cylinders and the pintle through longitudinal passageways 122 and radial passageways 123 and 124.

Also similar to free outer race 28 in pump/motor 10, outer race 128 is a free outer race hydrostatically supported by fluid recesses 136 and 138 within thrust pad 132. Outer race 128 is spherically matched to spherically crowned slipper shoes 115 of cylinders 114 permitting cylinder 114 rotation and spherical lapping of the spherical slippers 115 to increase wear life.

Figure 5:
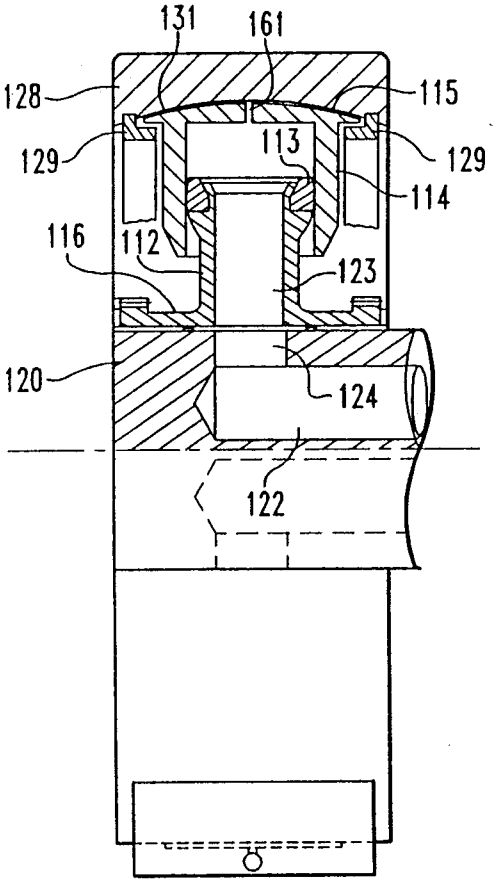
FIG. 5 is a partial side cross-sectional view of the slipper shoe-type radial hydrostatic pump/motor of FIG. 4.

Referring now to FIG. 5, spherical outer race 128 includes guides 129 for limiting the amount the cylinder slipper shoes can lift off at nominal pressures. Otherwise, the spherical outer race and spherical slippers are free to rotate and travel with the rotor to reduce slippage. A fluid orifice 161 is provided which fluidly couples the cylinder with the spherical interface between the outer race and the slipper shoe to lubricate the spherical joint and prevent wear occurring during slippage. Additionally, the spherical cylinder slipper shoes are faced with a bronze liner 131 or can be coated with TEFLON®. Centrifugal fluid effects also provide fluid pressure at the spherical interface to hydrostatically react loads transferred between the outer race and the rotor.

Other configurations incorporating a free outer race spherically interfacing with the rotor are contemplated as well. For example, referring to FIG. 6 spherical outer race 128 is shown with a spherically crowned ball piston 212. In this embodiment, the spherically crowned ball piston 212 is coated with a TEFLON® liner 231 for contacting the race 128. A rotor 216 includes cylinders 214 for receiving the ball piston 212. Fluid passageways 222 communicate fluid to cylinders 214 via radial passageways 223 and 224. Similarly, passageways 225 and 226 communicate fluid to the spherical interface between the ball piston 212 and spherical outer race 128.

Figure 7A:
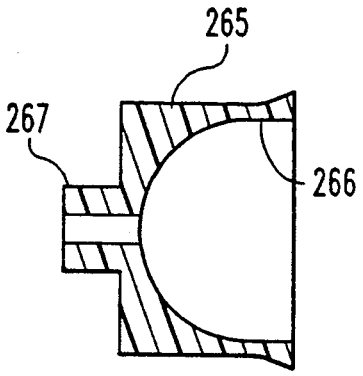
Figure 7B:
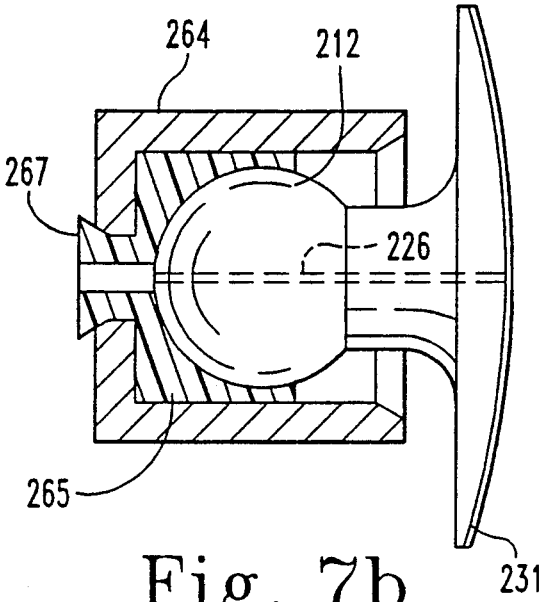
Figure 7C:
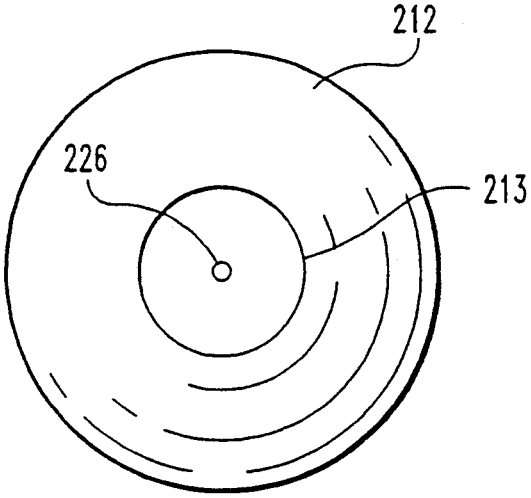

A thrust cup assembly 263 transfers loads while facilitating the reciprocative motion between the ball piston 212 and cylinder 214. Thrust cup assembly 263 includes a bushing housing 264 exteriorly fitted within cylinder 214 and containing a fitted bushing cup 265 therein for receiving ball piston 212. Bushing cup 265 ensures a tight fit with the ball piston by conforming thereto during assembly. For example, in FIG. 7*a*, bushing cup 265 is shown in its free state prior to assembly, wherein a semi-spherical cylindrical pocket 266 is sized to receive ball piston 212 therein. During assembly of the bushing cup and ball piston within the bushing housing 264, the bushing cup 265 is deformed about the ball piston (See FIG. 7*b*). To retain the bushing cup and ball piston within the bushing housing, cup stem 267 is swagged to the cup housing 264. To facilitate construction, bushing housing 264 is constructed of steel, while bushing cup 265 is constructed of bronze. Other constructions lending themselves to this assembly technique are also contemplated. For example, the bushing housing and bushing cup may be integrally formed from TEFLON® or other such low-friction plastic, and deformable upon assembly within the cylinder 214. Referring now to FIG. 7*c*, ball piston 212 is shown including a hydrostatic recess 213 fluidly coupled to cylinder 214 via passageways 225 and 226. In this embodiment, ball piston 212 is hydrostatically supported on bearing race 128 via pressurized working fluid in recess 213.

To reduce friction and increase component life, the principal features of this design include a full floating outer race supported on a low friction hydrostatic bearing. The race rotation carries the ball pistons and replaces high speed rolling or sliding contact with low speed oscillatory contact. The TEFLON® thrust cups are fluid pressure balanced to substantially reduce high speed friction. Tilted cylinders also reduce torque piston side loads.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A hydraulic pump/motor, comprising:

a housing;

a pintle mounted within said housing, said pintle including a plurality of inlet fluid passageways and a plurality of exit fluid passageways, said plurality of inlet fluid passageways receiving working fluid supplied to the pump/motor and said plurality of exit fluid passageways exhausting working fluid from the pump/motor;

a rotor rotatably mounted on said pintle, said rotor including a plurality of outwardly facing radially disposed cylinders having a corresponding plurality of longitudinal axes extending therethrough, said longitudinal axes defining a thrust load plane of said rotor;

means for fluidly coupling said plurality of cylinders with the plurality of inlet fluid passageways and the plurality of exit fluid passageways of said pintle;

a plurality of spherical balls corresponding to the plurality of cylinders in said rotor, each of said plurality of spherical balls being reciprocatably disposed within a corresponding one of said plurality of cylinders, said spherical balls sealing working fluid within said cylinders and developing radial thrust loads in the thrust load plane of said rotor;

a free outer bearing race eccentrically disposed about said rotor and pintle, said bearing race being located by the radial thrust loads and rotating at a near synchronous speed with said rotor to reduce rolling and sliding of said spherical balls relative to said free outer bearing race;

means for hydrostatically supporting said free outer bearing race in said housing, said hydrostatic supporting means including a rotatably adjustable servo piston having first hydrostatic recesses for hydrostatically supporting said bearing race, said bearing race being free to rotate on the first hydrostatic recesses, and said servo piston translating within said housing to adjust the eccentricity of said bearing race to said rotor and pintle and said servo piston rotating within said housing to align said bearing race with the thrust load plane of said rotor; and wherein said spherical balls reciprocate within said cylinders as said rotor rotates eccentrically relative to said outer bearing race so that working fluid is communicated between said cylinders and the inlet and exit fluid passageways of said pintle.

2. The hydraulic pump/motor of claim 1, wherein each of said plurality of radial cylinders is tilted in the thrust load plane of said rotor at an angle relative to a true radial orientation.

3. The hydraulic pump/motor of claim 2, and further comprising a plurality of thrust cups corresponding to said plurality of cylinders, each of said thrust cups being fitted to a corresponding one of said spherical balls and within a corresponding cylinder, said thrust cups transferring loads from said spherical balls to said cylinders.

4. The hydraulic pump/motor of claim 3, wherein:

each of said thrust cups includes a second hydrostatic recess adjacent said spherical ball and means for fluidly coupling said second hydrostatic recess to the corresponding cylinder;

pressurized working fluid within the corresponding cylinder communicates with said second hydrostatic recess to hydrostatically support said spherical ball in said thrust cup; and centrifugal force and the small differential fluid thrust pressure on the thrust cup also improves the thrust cup seal between the ball piston and the cylinder.

5. The hydraulic pump/motor of claim 4, wherein said servo piston is translatable within said housing to a position which aligns said free outer bearing race concentric about said rotor and pintle.

6. A hydraulic pump/motor, comprising:

a housing;

a pintle mounted within said housing, said pintle including a plurality of inlet fluid passageways and a plurality of exit fluid passageways, said plurality of inlet fluid passageways receiving working fluid supplied to the pump/motor and said plurality of exit fluid passageways exhausting working fluid from the pump/motor;

a rotor rotatably mounted on said pintle, said rotor including a plurality of outwardly facing radially disposed cylinders;

means for fluidly coupling said plurality of cylinders with the plurality of inlet fluid passageways and the plurality of exit fluid passageways of said pintle;

a plurality of spherical balls corresponding to the plurality of cylinders in said rotor, each of said plurality of spherical balls being reciprocatably disposed within a corresponding one of said plurality of cylinders, said spherical balls sealing working fluid within said cylinders;

a free outer bearing race eccentrically disposed about said rotor and pintle, said bearing race being free to rotate with said rotor as said rotor rotates about said pintle;

means for rotatably supporting said free outer bearing race in said housing, including;

a first thrust pad mounted in said housing;

a second translatable thrust pad movably mounted in said housing opposite said first thrust pad, said second translatable thrust pad being operable to fully support said free outer bearing race against said first thrust pad;

a hydrostatic recess disposed within said second translatable thrust pad and adjacent to said free outer bearing race;

said second translatable thrust pad being fitted to said bearing race to seal working fluid in said hydrostatic recess;

means for supplying working fluid to said hydrostatic recess, said means for supplying sealing working fluid in said hydrostatic recess to hydrostatically support said free outer bearing race on said second translatable thrust pad as said free outer bearing race rotates thereon; and means for varying the eccentricity of said free outer bearing race relative to said rotor, said means for varying the eccentricity including means for translating said second translatable thrust pad to vary the eccentricity of said outer bearing race, said second translatable thrust pad supporting said free outer bearing race against said first thrust pad as said outer bearing race translates;

wherein said spherical balls reciprocate within said cylinders as said rotor rotates eccentrically relative to said outer bearing race so that working fluid is communicated between said cylinders and the inlet and exit fluid passageways of said pintle.

7. The hydraulic pump/motor of claim 6, wherein said means for varying the eccentricity of said bearing race relative to said rotor includes:

a piston member reciprocatably disposed within said housing;

said piston member defining a first fluid chamber with said housing at one end of said piston member, and said piston member defining a second fluid chamber with said housing at the other end of said piston member;

means for fluidly coupling said first fluid chamber with said second fluid chamber;

means for supplying pressurized working fluid to said first fluid chamber;

means for controlling the flow of working fluid from said first fluid chamber to said second fluid chamber, said controlling means sealing working fluid in said first fluid chamber to bias said piston member in a first direction and said controlling means communicating working fluid from said first fluid chamber to said second fluid chamber to oppositely bias said piston member in a second direction.

8. The hydraulic pump/motor of claim 7, wherein:

said piston member includes said second translatable thrust pad and said piston member is rotatably disposed in said housing;

said piston member rotating about its longitudinal axis to align said thrust pad with said free outer bearing race.

9. The hydraulic pump/motor of claim 6, wherein each of said plurality of radial cylinders is tilted at an angle relative to a true radial orientation.

10. The hydraulic pump/motor of claim 9, and further comprising a plurality of thrust cups corresponding to said plurality of cylinders, each of said thrust cups being fitted to a corresponding one of said spherical balls and within a corresponding cylinder, said thrust cups transferring loads from said spherical balls to said cylinders and sealing fluid leakage between the balls and cylinders.

11. The hydraulic pump/motor of claim 10, wherein:

each of said thrust cups includes a hydrostatic recess adjacent said spherical ball and means for fluidly coupling said hydrostatic recess to the corresponding cylinder; and pressurized working fluid within the corresponding cylinder communicates with said recess to hydrostatically support said spherical ball in said thrust cup.

12. A hydraulic pump/motor, comprising:

a housing;

a pintle mounted within said housing, said pintle including a plurality of inlet fluid passageways and a plurality of exit fluid passageways, said plurality of inlet fluid passageways receiving working fluid supplied to the pump/motor and said plurality of exit fluid passageways exhausting working fluid from the pump/motor;

a rotor rotatably mounted on said pintle, said rotor including a plurality of outwardly facing radially disposed cylinders;

means for fluidly coupling said plurality of cylinders with the plurality of inlet fluid passageways and the plurality of exit fluid passageways of said pintle;

a plurality of spherical balls corresponding to the plurality of cylinders in said rotor, each of said plurality of spherical balls being reciprocatably disposed within a corresponding one of said plurality of cylinders, said spherical balls sealing working fluid within said cylinders;

a free outer bearing race eccentrically disposed about said rotor and pintle, said bearing race being free to rotate with said rotor as said rotor rotates about said pintle; and means for hydrostatically supporting said free outer bearing race in said housing, said means for hydrostatically supporting including means for varying the eccentricity of said free outer bearing race relative to said rotor;

said means for varying the eccentricity including;

a piston member reciprocatably disposed within said housing;

said piston member defining a first fluid chamber with said housing at one end of said piston member, and said piston member defining a second fluid chamber with said housing at the other end of said piston member;

means for fluidly coupling said first fluid chamber with said second fluid chamber;

means for controlling the flow of working fluid from said first fluid chamber to said second fluid chamber to bias said piston member in first and second directions;

wherein said spherical balls reciprocate within said cylinders as said rotor rotates eccentrically relative to said outer bearing race so that working fluid is communicated between said cylinders and the inlet and exit fluid passageways of said pintle.

13. The hydraulic pump/motor of claim 12, wherein:

said first fluid chamber has a first cross-sectional area and said second fluid chamber has a second cross-sectional area greater than said first cross-sectional area;

said means for fluidly coupling said first fluid chamber with said second fluid chamber includes a check valve; and said means for controlling the flow of working fluid from said first fluid chamber to said second fluid chamber includes means for controlling working fluid pressure across said check valve, wherein said check valve is controlled open to flow working fluid from said first fluid chamber to said second fluid chamber to bias said piston towards said first fluid chamber and wherein said check valve is controlled closed and said second fluid chamber is vented to oppositely bias said piston member towards said second fluid chamber.

14. The hydraulic pump/motor of claim 13, wherein said second cross-sectional area is twice said first cross-sectional area.

* * * * *